US010827243B1

(12) United States Patent
Peana et al.

(10) Patent No.: US 10,827,243 B1
(45) Date of Patent: Nov. 3, 2020

(54) METHOD AND APPARATUS FOR FABRICATING AN INFORMATION HANDLING SYSTEM WITH A VIBRATION ACTUATOR SPEAKER SYSTEM ASSEMBLY

(71) Applicant: Dell Products, LP, Round Rock, TX (US)

(72) Inventors: Stefan Peana, Austin, TX (US); Maxwell S. Andrews, Novato, CA (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 16/551,391

(22) Filed: Aug. 26, 2019

(51) Int. Cl.

| | |
|---|---|
| ***H04R 1/02*** | (2006.01) |
| ***H04R 9/06*** | (2006.01) |
| ***H04R 9/02*** | (2006.01) |
| ***H04R 17/00*** | (2006.01) |

(52) U.S. Cl.
CPC ..... *H04R 1/025* (2013.01); *H04R 9/025* (2013.01); *H04R 9/06* (2013.01); *H04R 17/00* (2013.01); *H04R 2400/03* (2013.01); *H04R 2499/15* (2013.01)

(58) Field of Classification Search
CPC ..... H04R 1/025; H04R 1/08; H04R 1/403; H04R 1/026; H04R 1/021; H04R 1/02; H04R 1/28; H04R 9/025; H04R 9/06; H04R 17/00; H04R 2400/03; H04R 2499/11; H04R 2499/15; H04R 2205/021; H04R 2201/021; H04R 2201/023; H04R 5/02; H04R 5/023; B60R 11/0217; B60R 2011/0045; H04S 7/40
USPC ..... 381/333, 332, 87, 388, 386
See application file for complete search history.

(56) References Cited

U.S. PATENT DOCUMENTS

| | | | | |
|---|---|---|---|---|
| 7,551,417 | B2 | 6/2009 | Miyata | |
| 8,934,228 | B2 | 1/2015 | Franklin | |
| 9,386,367 | B2 * | 7/2016 | Onishi | H04M 1/0254 |
| 9,818,805 | B2 | 11/2017 | Choi | |
| 10,416,707 | B2 * | 9/2019 | Choi | G06F 1/1688 |
| 10,524,033 | B2 * | 12/2019 | Vaturi | H04R 1/028 |
| 2002/0064290 | A1 | 5/2002 | Reynaga | |
| 2006/0140439 | A1 | 6/2006 | Nakagawa | |
| 2007/0202917 | A1 | 8/2007 | Phelps | |

(Continued)

*Primary Examiner* — Ahmad F. Matar
*Assistant Examiner* — Sabrina Diaz
(74) *Attorney, Agent, or Firm* — Prol Intellectual Property Law, PLLC; H. Kenneth Prol

(57) ABSTRACT

A method of fabricating an information handling system chassis may comprise operably connecting an A-cover housing a digital display to a chassis base, via a hinge, forming an opening into a space between the A-cover and the digital display, inserting a first interchangeable vibration actuator housing a first vibration actuator, selected from a plurality of different types of vibration actuators into the opening of the A-cover, such that a first surface of the first vibration actuator housing lies substantially coplanar with the rear surface of the A-cover, and a second surface of the first vibration actuator housing is situated adjacent the rear surface of the digital display. The method may also include transmitting code instructions to the first vibration actuator, and transducing the code instructions, via the first vibration actuator, to cause a first corresponding movement of at least a portion of the digital display to produce a vibration.

20 Claims, 4 Drawing Sheets

CROSS-SECTIONAL SIDE VIEW

(56) References Cited

U.S. PATENT DOCUMENTS

| | | | | |
|---|---|---|---|---|
| 2008/0080730 | A1* | 4/2008 | Takakusaki | H04R 5/02 381/300 |
| 2009/0097692 | A1* | 4/2009 | Sakamoto | H04R 7/045 381/388 |
| 2012/0242592 | A1* | 9/2012 | Rothkopf | G06F 1/1652 345/173 |
| 2015/0201273 | A1 | 7/2015 | Ooi | |
| 2017/0055054 | A1* | 2/2017 | Brogan | A45C 11/00 |
| 2017/0064474 | A1 | 3/2017 | Clerici | |
| 2017/0116977 | A1 | 4/2017 | Logan | |
| 2017/0280216 | A1* | 9/2017 | Lee | H04R 7/045 |

* cited by examiner

CROSS-SECTIONAL SIDE VIEW

METHOD AND APPARATUS FOR FABRICATING AN INFORMATION HANDLING SYSTEM WITH A VIBRATION ACTUATOR SPEAKER SYSTEM ASSEMBLY

FIELD OF THE DISCLOSURE

The present disclosure generally relates to fabrication of a chassis of an information handling system. The present disclosure more specifically relates to integration of a vibration actuator-based speaker incorporated within a narrow bezel chassis.

BACKGROUND

As the value and use of information continues to increase, individuals and businesses seek additional ways to process and store information. One option available to clients is information handling systems. An information handling system generally processes, compiles, stores, and/or communicates information or data for business, personal, or other purposes thereby allowing clients to take advantage of the value of the information. Because technology and information handling needs and requirements vary between different clients or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific client or specific use, such as e-commerce, financial transaction processing, airline reservations, enterprise data storage, or global communications. In addition, information handling systems may include a variety of hardware and software components that may be configured to process, store, and communicate information and may include one or more computer systems, data storage systems, and networking systems. The information handling system may include telecommunication, network communication, and video communication capabilities. Further, the information handling system may include one or more speakers capable of emitting audible sound.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

The market for information handling systems prizes ease of mobility, driving manufacture of ever-lighter, slimmer chasses. Introduction of narrow bezel technology has improved product form factor by eliminating any extension of the chassis outside the edges of the display. Prior to the advent of narrow bezel technology, chassis surface area extending in any direction outward from the display edges may have been used to house speaker assemblies. Because such additional chassis surface area is no longer available, a new location for sound-generating devices is needed.

Embodiments of the present disclosure address this issue by incorporating an acoustic vibrator within the chassis lid that causes a portion of the digital display to vibrate and generate audible sound or vibrational tactile feedback outside the audible range of sound. Such an acoustic vibrator working in conjunction with the digital display may enhance tactile user experience, negate the need for other exterior speakers, or enhance available plural speaker options, without increasing the thickness of the chassis lid.

Figure 1:
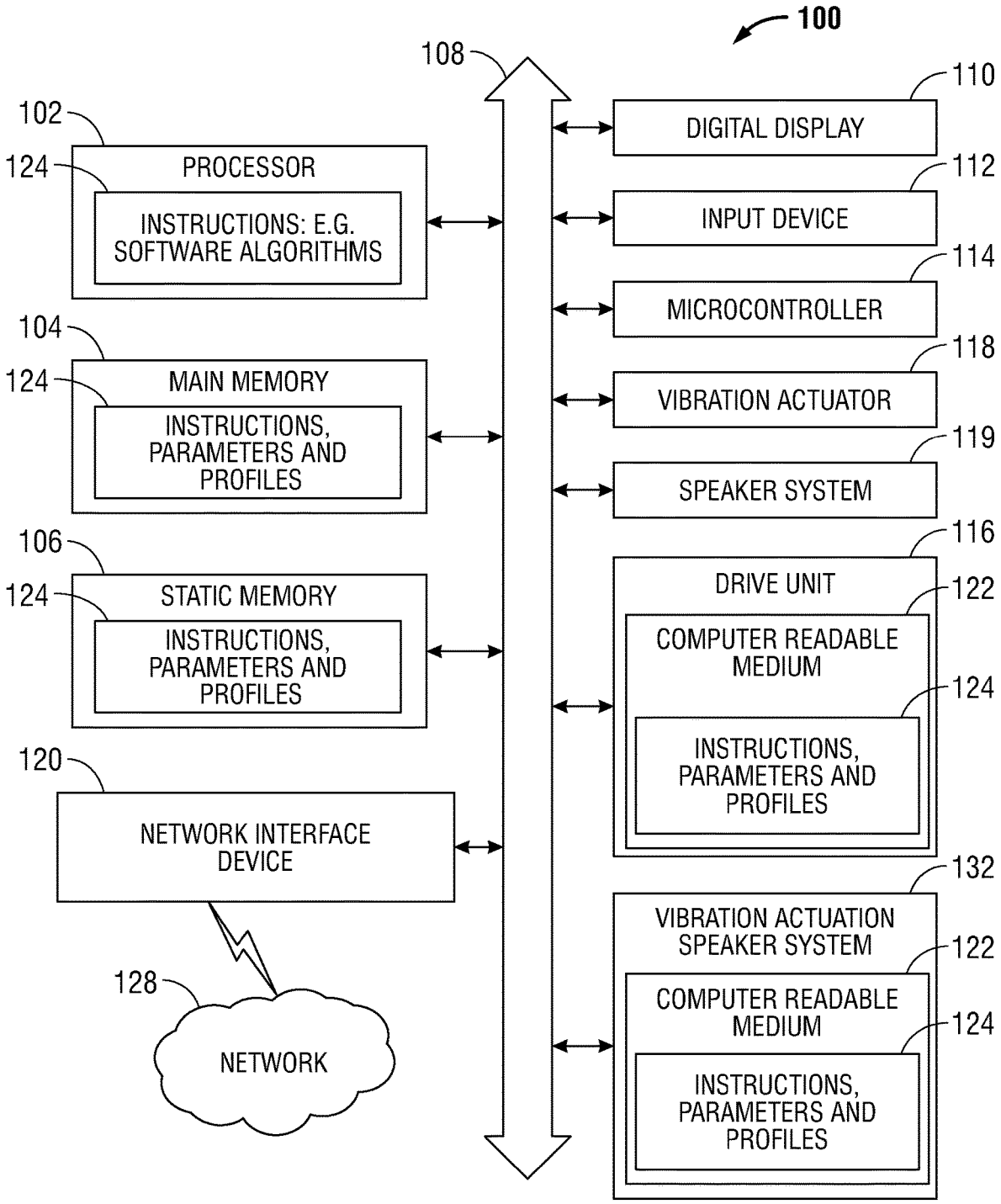
FIG. 1 is a block diagram illustrating an information handling system according to an embodiment of the present disclosure.

FIG. 1 illustrates an information handling system 100 similar to information handling systems according to several aspects of the present disclosure. In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, mobile device (e.g., personal digital assistant (PDA) or smart phone), server (e.g., blade server or rack server), a consumer electronic device, a network server or storage device, a network router, switch, or bridge, wireless router, or other network communication device, a network connected device (cellular telephone, tablet device, etc.), IoT computing device, wearable computing device, a set-top box (STB), a mobile information handling system, a palmtop computer, a laptop computer, a desktop computer, a communications device, an access point (AP), a base station transceiver, a wireless telephone, a land-line telephone, a control system, a camera, a scanner, a facsimile machine, a printer, a pager, a personal trusted device, a web appliance, or any other suitable machine capable of executing a set of instructions (sequential or otherwise) that specify actions to be taken by that machine, and can vary in size, shape, performance, price, and functionality.

In a networked deployment, the information handling system 100 may operate in the capacity of a server or as a client computer in a server-client network environment, or as a peer computer system in a peer-to-peer (or distributed) network environment. In a particular embodiment, the computer system 100 can be implemented using electronic devices that provide voice, video or data communication. For example, an information handling system 100 may be any mobile or other computing device capable of executing a set of instructions (sequential or otherwise) that specify actions to be taken by that machine. Further, while a single information handling system 100 is illustrated, the term "system" shall also be taken to include any collection of systems or sub-systems that individually or jointly execute a set, or multiple sets, of instructions to perform one or more computer functions.

The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (110) devices, such as a keyboard, a mouse, a video/graphic display, or any combination thereof. The information handling system can also include one or more buses 108 operable to transmit communications between the various hardware components. Portions of an information handling system may themselves be considered information handling systems.

Information handling system 100 can include devices or modules that embody one or more of the devices or execute instructions for the one or more systems and modules described above, and operates to perform one or more of the methods described above. The information handling system 100 may execute code instructions 124 that may operate on servers or systems, remote data centers, or on-box in individual client information handling systems according to various embodiments herein. In some embodiments, it is understood any or all portions of code instructions 124 may operate on a plurality of information handling systems 100.

The information handling system 100 may include a processor 102 such as a central processing unit (CPU), control logic or some combination of the same. In some embodiments, the processor 102 may be a graphics processing unit (GPU). Any of the processing resources may operate to execute code that is either firmware or software code. Moreover, the information handling system 100 can include memory such as main memory 104, static memory 106, computer readable medium 122 storing instructions 124 of the vibration actuation speaker system 132, and drive unit 116 (volatile (e.g. random-access memory, etc.), nonvolatile (read-only memory, flash memory etc.) or any combination thereof). The information handling system 100 can also include one or more buses 108 operable to transmit communications between the various hardware components such as any combination of various input and output (I/O) devices.

As shown, the information handling system 100 may further include a digital display 110. The digital display 110 in an embodiment may function as a liquid crystal display (LCD), an organic light emitting diode (OLED), a flat panel display, or a solid state display. Additionally, the information handling system 100 may include an input device 112, such as a keyboard, and/or a cursor control device, such as a mouse, touchpad, or gesture or touch screen input.

The information handling system 100 can also include a disk drive unit 116, and a vibration actuator 118, which may operate to transduce electrical signals into mechanical vibrations. It is understood any device capable of generating mechanical vibration in response to received electrical command signals may comprise the vibration actuator 118 in an embodiment. In some embodiments, the vibration actuator 118 may comprise a linear resonant actuator that receives commands in the form of alternating current to drive a suspended voice coil pressed against a movable plate. By driving the voice coil up and down against the restorative force of the suspension via an interaction with a magnetic flux field, the linear resonant actuator in such an embodiment may produce mechanical displacement of the moveable plate and thereby induce vibration into any medium in contact with the moveable plate. In other embodiments, the vibration actuator 118 may comprise a planar magnetic transducer that motivates a diaphragm through electromagnetic interaction between one or more permanents magnets placed along the diaphragm and one or more electrically conductive wires situated on or near the surface of the diaphragm; the conductive wires inducing a mechanical motivation in the diaphragm material as an induced electric current through the wires interacts with the magnetic field inherent to the proximal permanent magnets in a manner which attracts or repels the wires toward or away from the magnetic poles created by the permanent magnets In yet other embodiments, the vibration actuator 118 may comprise a piezoelectric actuator that operates by deforming a piezoelectric material through an application of electrical voltage to the material, causing a mechanical deformation in the piezoelectric element Movement of the piezoelectric material in such an embodiment may also cause movement of a diaphragm or membrane in contact with the piezoelectric material, which may improve the transfer of mechanical energy into the surrounding atmosphere Such a piezoelectric actuator in an embodiment may be a stack or sheet actuator, for example. A microcontroller 114 in each of these example embodiments, or in other contemplated embodiments may provide an optimized electrical command or signal, causing the vibration actuator 118 to affect mechanical movement in a way which is advantageous to the conversion efficiency of electrical energy into mechanical energy by such an actuator. Such methods to optimize the efficiency of mechanical energy production from an electrical signal include measuring the electrical feedback in series with the vibration actuator and modifying the voltage or current parameters to conform to a desired model, tuning the amplitude of select frequency outputs accounting for resonant modes within the actuator's mechanical suspension system, and reducing the amplitude of signals at certain frequencies to privilege the amplitude of signals at other frequencies. The microcontroller 114 may also limit the voltage or amplitude of electrical signals applied to vibration actuator 118 in order to avoid inducing motion responses that could exceed the mechanical limits of the suspension mechanism or other mechanical limits elsewhere in the device that may be impacted by the vibratory motion of the vibration actuator 118, which may otherwise result in distortions to the induced atmospheric vibrations relative to the input signal, and may also result in damage to the mechanical assembly of either vibration actuator 118 or other mechanical components of information handling system 100.

The information handling system 100 may also include the vibration actuation speaker system 132 that may be operably connected to the bus 108. The vibration actuation speaker system 132 computer readable medium 122 may also contain space for data storage. The vibration actuation speaker system 132 may perform tasks related to generating electrical signals for delivery to the vibration actuator 118, causing movement thereof or of an adjacent diaphragm or membrane. In an embodiment, the vibration actuation speaker system 132 may communicate with the main memory 104, the processor 102, the digital display 110, the alpha-numeric input device 112, the microcontroller 114, and the network interface device 120 via bus 108, and several forms of communication may be used, including ACPI, SMBus, a 24 MHZ BFSK-coded transmission channel, or shared memory. In other aspects, the vibration actuation speaker system 132 may coordinate with speaker drivers of other speaker systems 119 of the information handling system.

In other embodiments, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. For example, the microcontroller 114 may execute instructions of the vibration actuation speaker system 132. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Further, inter-device connectivity may be available via WPAN standards or via Bluetooth or similar standards. It is understood that other devices such as peripheral devices may be connected via wireless or wired connectivity as well according to various protocols described herein.

The information handling system 100 can include a set of instructions 124 that can be executed to cause the computer system to perform any one or more of the methods or computer based functions disclosed herein. For example, instructions 124 may execute a vibration actuation speaker system 132, software agents, or other aspects or components. Various software modules comprising application instructions 124 may be coordinated by an operating system (OS), and/or via an application programming interface (API). An example operating system may include Windows®, Android®, and other OS types known in the art. Example APIs may include WinAPIs (e.g. Win32, Win32s, Win64, and WinCE), Core Java API, or Android APIs.

The disk drive unit 116 and the vibration actuation speaker system 132 may include a computer-readable medium 122 in which one or more sets of instructions 124 such as software can be embedded. Similarly, main memory 104 and static memory 106 may also contain a computer-readable medium for storage of one or more sets of instructions, parameters, or profiles 124. The disk drive unit 116 and static memory 106 also contain space for data storage. Further, the instructions 124 may embody one or more of the methods or logic as described herein. For example, instructions relating to the vibration actuation speaker system 132 software algorithms may be stored here. In a particular embodiment, the instructions, parameters, and profiles 124 may reside completely, or at least partially, within the main memory 104, the static memory 106, microcontroller 114, and/or within the disk drive 116 during execution by the processor 102 of information handling system 100. As explained, some, or all of the vibration actuation speaker system 132 may be executed locally or remotely. The main memory 104 and the processor 102 also may include computer-readable media.

Main memory 104 may contain computer-readable medium (not shown), such as RAM in an example embodiment. An example of main memory 104 includes random access memory (RAM) such as static RAM (SRAM), dynamic RAM (DRAM), non-volatile RAM (NV-RAM), or the like, read only memory (ROM), another type of memory, or a combination thereof. Static memory 106 may contain computer-readable medium (not shown), such as NOR or NAND flash memory in some example embodiments. The vibration actuation speaker system 132 and the drive unit 116 may include a computer-readable medium 122 such as a magnetic disk, or a static memory in an example embodiment. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

In other embodiments, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

When referred to as a "system", a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device). The system, device, or module can include software, including firmware embedded at a device, such as a Intel® Core class processor, ARM® brand processors, Qualcomm® Snapdragon processors, or other processors and chipset, or other such device, or software capable of operating a relevant environment of the information handling system. The system, device or module can also include a combination of the foregoing examples of hardware or software. In an example embodiment, the error revision suggestion system 128 or the customized data integration software application creation system 126 above and the several modules described in the present disclosure may be embodied as hardware, software, firmware or some combination of the same. Note that an information handling system can include an integrated circuit or a board-level product having portions thereof that can also be any combination of hardware and software. Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Figure 2:
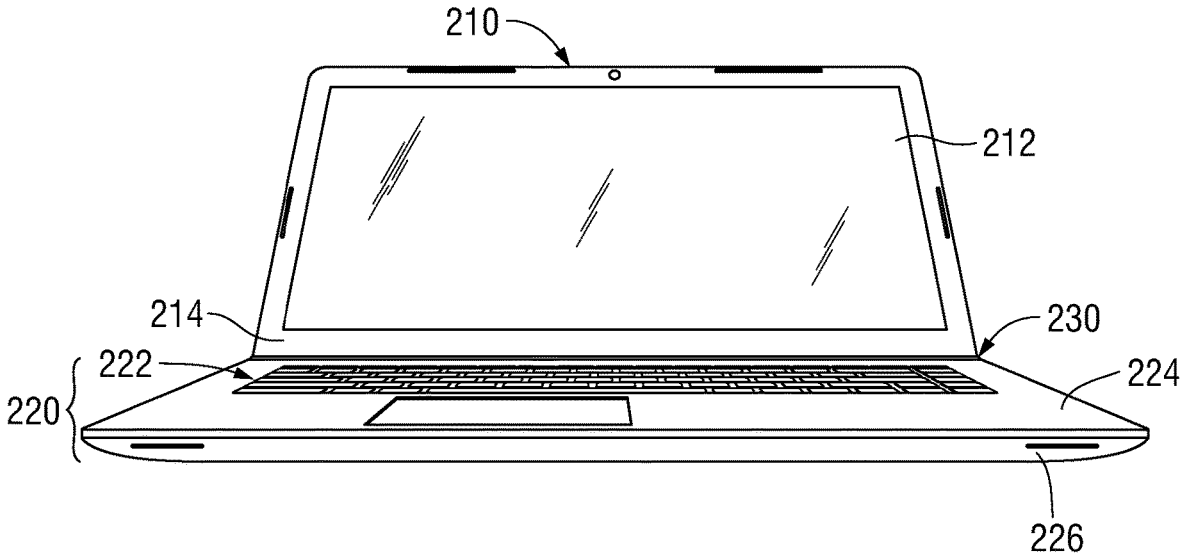
FIG. 2 is a graphical front-view of an information handling system chassis according to an embodiment of the present disclosure.

FIG. 2 is a graphical front-view of an information handling system chassis according to an embodiment of the present disclosure. The chassis in an embodiment may include a display chassis 210 housing a digital display 212, that is operably connected to a base chassis 220 housing a keyboard 222 via a hinge 230. Each of these chassis portions 210 and 220 in an embodiment may further comprise one or more chassis covers. For example, a display chassis 210 may include a B cover 214 surrounding or enclosing the digital display 212 bonded to an A cover (not shown here, but discussed in greater detail with respect to FIG. 3). As another example, the base chassis 220 in an embodiment may include a C cover 224 surrounding or enclosing the keyboard 222, bonded or joined to a D cover 226 forming the base of the information handing system chassis.

As described herein, introduction of narrow bezel technology has improved product form factor by eliminating any extension outside the display, which can reduce the overall form factor for a given display size, resulting in a more compact product that is more readily transportable by users of the product. For example, narrow bezel technology has resulted in a decrease in the space between each edge of the B cover 214 and each exterior edge of the digital display 212. In previous systems, the space between one or more edges of the B cover 214 and one or more edges of the digital display 212 may have housed speakers. Current market trends have also prompted ever-slimmer base chasses 220, and fewer visible mechanisms, interfaces, and textured surfaces on the C cover. For example, many existing systems now tend toward a C cover having a sleek singular surface outside of the keyboard, or touchpad. This has resulted in a decrease in available space within the base chassis 220 to house one or more speaker systems (e.g., especially with respect to speaker systems operating in the bass range), and less surface area in the C cover for such speaker system output openings. As this area decreases, with the advent of narrow bezel technology and thin, seamless base chasses 220, placement of such speakers and required opening in either the display chassis 210 or the base chassis 220 becomes more challenging in model specifications, and may result in the specification of loudspeaker components which fail to meet the desired performance in terms of frequency response, amplitude, or total harmonic distortion.

Figure 3:
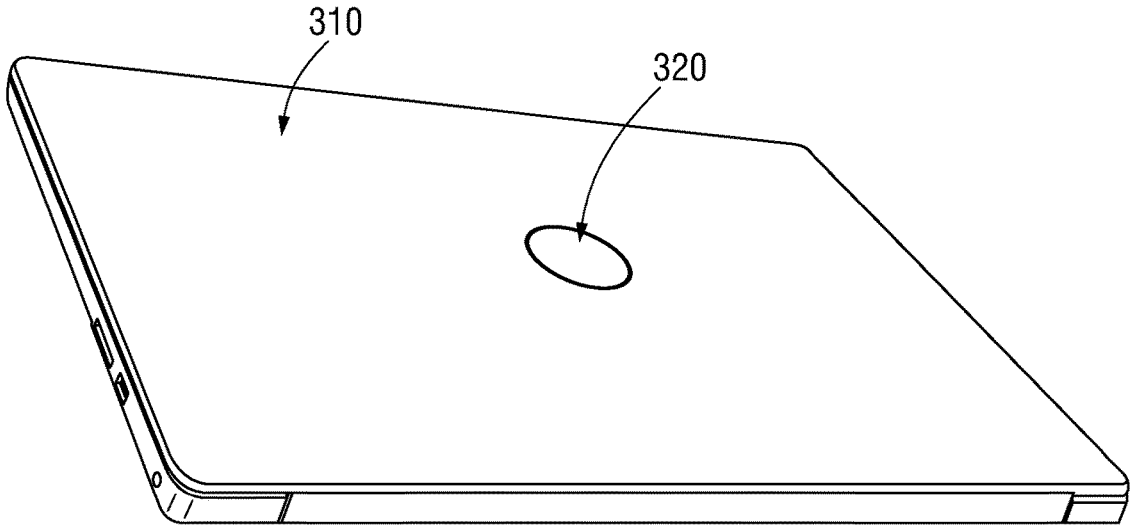
FIG. 3 is a graphical top-view of an information handling system chassis according to an embodiment of the present disclosure.

FIG. 3 is a graphical top-view of a form-factor information handling system chassis according to an embodiment of the present disclosure. The display chassis in an embodiment may further include a top cover or A-cover 310 forming the lid of the information handling system when the chassis is placed in a closed clamshell configuration. For example, the chassis shown in FIG. 3 is illustrated in a closed configuration. In such an example embodiment, an A cover 310 of the display chassis may be visible as the top exterior surface or lid of the information handling system chassis. The A cover 310 in an embodiment may be bonded or joined with the B cover (not shown here, but discussed in greater detail with respect to FIG. 2) to form the display chassis. The A cover 310 in an embodiment may be fabricated with an opening, into which a removable speaker housing 320 may be placed or inserted for some model specifications selecting such an option. A plurality of interchangeable removable speaker housings 320 may be insertable within such an opening in the A cover 310, based upon user-preferences and type of speaker desired for various model upgrade options. In other words, each of the interchangeable removable speaker housings 320 in an embodiment may offer different sound or sub-audible vibration performance characteristics (e.g., frequency ranges, sound quality) or no A-cover speaker may be selected for some model options. Upon insertion of such a removable speaker housing 320 in an embodiment, the removable speaker housing 320 may be bonded, glued, or otherwise affixed to the A cover 310, and electrically connected to speaker driver systems.

Figure 4:
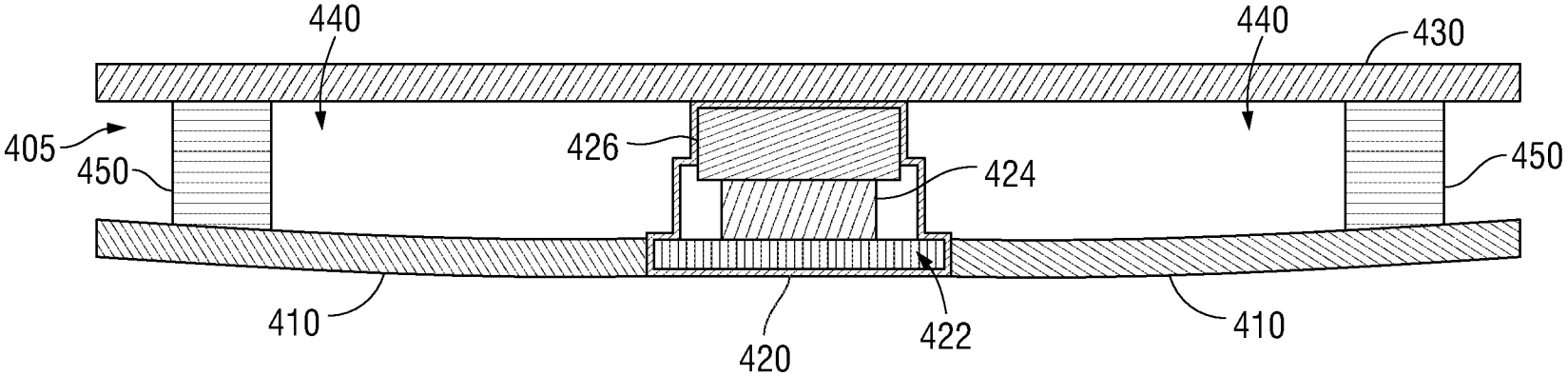
FIG. 4 is a cross-sectional side view of a form-factor information handling system chassis lid according to an embodiment of the present disclosure.

FIG. 4 is a cross-sectional side view of a vibration actuator housing disposed within a space within the information handling system chassis lid (A-cover) according to an embodiment of the present disclosure. As described herein, there is a need to relocate or add loudspeakers previously placed around the perimeter of a digital display or B cover into another location within the display chassis. However, there is a competing need to maintain a slim form factor for the base chassis and a narrow bezel in the display chassis. Typically, an A cover will have a slightly curved cross-section between edges of the display chassis forming a space 405 between a digital display 430 and an A cover 410 in the middle area. There also may exist an air-gap distance between some areas of digital display 430 and A cover 410 which contributes to space 405, designed as such to improve robustness to vibration or mechanical impacts that might otherwise damage digital display 430 if such air-gaps were not employed. Embodiments of the present disclosure address these competing needs by leveraging the membranous characteristics of the digital display to act as the membrane or diaphragm of the loudspeaker and a space 405 between an A cover 410 and back of the digital display 430. This decreases the need for additional membranes or diaphragms, and consequently decreases the space required to house a loudspeaker, which may be reclaimed for other system components, or used to further reduce the product form factor. It also provides use of unused space 405 to accommodate air cavity 440 for greater loudspeaker compliance volume or for enhanced generation of sub-audible vibration in tactile response methods. In addition, embodiments of the present disclosure employ vibration actuators 424 to move the digital display so as to produce audible sound or provide vibrational tactile feedback. Use of such vibration actuators in an embodiment may also negate the need for bulky diaphragm components of existing loudspeakers to generate audible bass frequencies of sound, thus further decreasing space required to house a loudspeaker system within information handling system 100.

For example, a removable loudspeaker housing 420 in an embodiment may be inserted temporarily or permanently into an A cover 410 of a display chassis, and affixed to one or both of the A cover 410 and digital display 430 via the use of an adhesive or other fastener commonly known in the art. The removable loudspeaker housing 420 in an embodiment may include a vibration actuator 424. The vibration actuator 424 in an example embodiment may comprise a linear resonant actuator that receives commands in the form of alternating current to drive a suspended voice coil in the presence of a magnetic flux field, bidirectionally against movable plate 426, which may be mechanically coupled to digital display 430, and speaker housing cap 422, which may be mechanically coupled to A cover 410. For example, the vibration actuator 424 in such an embodiment may house a mechanically suspended voice coil and a permanent magnet which may produce a magnetic flux field within which the voice coil operates, and the vibration actuator 424 may abut or be situated adjacent a moveable plate 426. The position of the vibration actuator 424 with respect to the A cover 410 in such an embodiment may be fixed, such that vibration actuator 424 may cause vertical movement of the plate 426 with respect to the A cover 410. The moveable plate 426 in such an embodiment may then contact the membranous or flexible rear surface of the digital display 430 to cause an audible sound or sub-audible vibration. It may be desirable, in some embodiments, for A cover 410 to be more rigid than digital display 430, such that vibration actuator 424 induces greater movement in the digital display 430 than in the A cover 410. Consequently, in such embodiments, the vibration of the digital display 430 may generate more sound waves in the area surrounding the digital display 430 than the A cover 410 generates in the area immediately surrounding A cover 410.

In another example embodiment, the vibration actuator 424 may comprise a planar magnetic transducer. In such an embodiment, the vibration actuator 424 may include one or more conductive wire traces on or within the structure of movable plate 426, which may be affixed to the rear surface of the digital display 430. The planar magnetic transducer operating as the vibration actuator 424 in such an embodiment may also include one or more permanent magnets affixed to speaker housing cap 422, closely situated to the rear surface of the digital display 430 and the conductive wire traces on or within movable plate 426. A microcontroller or processor may execute code instructions of the vibration actuator speaker system in an embodiment to apply a voltage to the electrically conductive wires. The electromagnetic interaction between the voltage applied to the conductive wire traces and the permanent magnets in such an embodiment may cause the membranous rear surface of the digital display 430 to move or vibrate relative to A cover 410, causing audible sound or sub-audible vibration to be imparted to the surface of digital display 430 and by extension to the surrounding atmosphere. In such an embodiment, the moveable plate 426 may not be incorporated within the removable speaker housing 420, and instead may be affixed discretely to digital display 430, and vibration actuator 424 may be placed in direct or close contact with the rear surface of movable plate 426.

In yet another embodiment, the vibration actuator 424 may comprise a piezoelectric actuator that deforms a piezoelectric material within the vibration actuator 424 by applying an electrical voltage to the material. The electrical voltage in such an embodiment may be supplied via a microcontroller, or a processor executing code instructions of the vibration actuator speaker system. The moveable plate 426 or the vibration actuator 424 in such an embodiment may not be incorporated within the removable speaker housing 420, and instead may be affixed discretely to the rear of digital display 430, with speaker housing cap 422 affixed in a subsequent assembly procedure. Movement of the piezoelectric material within the vibration actuator 424 in such an embodiment may also move the flexible rear surface of the digital display 430, to cause audible sound or sub-audible vibration to be imparted to the surface of digital display 430 and by extension the surrounding atmosphere.

In some embodiments, the removable speaker housing 420 may include more than one vibration actuator 424. Different types of vibration actuators in an embodiment may produce different ranges of audible sound frequencies or sub-audible vibrational tactile feedback. For example, some actuators may cause the flexible rear surface of the digital display 430 to produce audible sound of a higher or lower frequency range than others. The audible sound frequency range produced by one type of actuator 424 may or may not partially overlap the audible sound frequency range produced by another type of actuator 424. Thus, in order to increase the total or combined range of audible sound frequencies that may be produced by mechanical oscillation of digital display 430 in an embodiment, multiple types of vibration actuators 424 may be included within the removable speaker housing 420 or additional, smaller loudspeaker systems may be deployed in other parts of the base chassis or display chassis. For example, high-frequency speakers may be deployed in a base chassis, along an edge or hinge, while a low-frequency (bass) speaker system may be displayed in removable speaker housing 420 in some embodiments. In another embodiment, removable speaker housing 420 may produce sounds only in the middle and high frequency audible range, while a low frequency bass loudspeaker can be employed in the base chassis without the need to directly radiate toward the listener. In other examples, an embodiment may combine two or more of a linear resonant actuator, a planar magnetic transducer, a piezoelectric magnetic actuator, or some other known type of mechanical actuator in the removable speaker housing 420. In still other embodiments, the removable speaker housing 420 may include one or more vibration actuators 424 producing sub-audible vibrations as part of a tactile response to a received command, such as a touch input received at a touch-sensitive digital display 430.

The removable speaker housing 420 in an embodiment may further include a cap 422 operating to insulate the vibration actuator 424 from the external surroundings, and to ease integration of the removable speaker housing 420 within the A cover 410. In other words, the cap 422 in an embodiment may take a form that allows the removable speaker housing 420 appear to be part of the A cover 410 upon insertion of the removable speaker housing 420 within the A cover 410. The removable speaker housing 420 may be bonded, glued, or otherwise fixed in place with respect to the A cover 410 in an embodiment. Likewise, movable plate 426 may also be bonded, glued, or otherwise fixed in placed to the rear surface of digital display 430. Cap 422 may resonate sound of vibration actuator 424 as well in some embodiments.

Sound insulators 450 may be inserted between the rear surface of the digital display 430 and the A cover 410, and may be situated perpendicularly with respect to the display 430 and the A cover 410. Such sound insulators 450 may operate to control distortion of sound caused by reflection of other internal components housed within the display chassis, and to optimize sound audible to the user. Air cavities 440 disposed between the sound insulators 450 and the removable speaker housing 420 may also operate to dampen unintended reflection of sound waves and increase the efficient reproduction of select sonic frequencies, in an embodiment.

Figure 5:
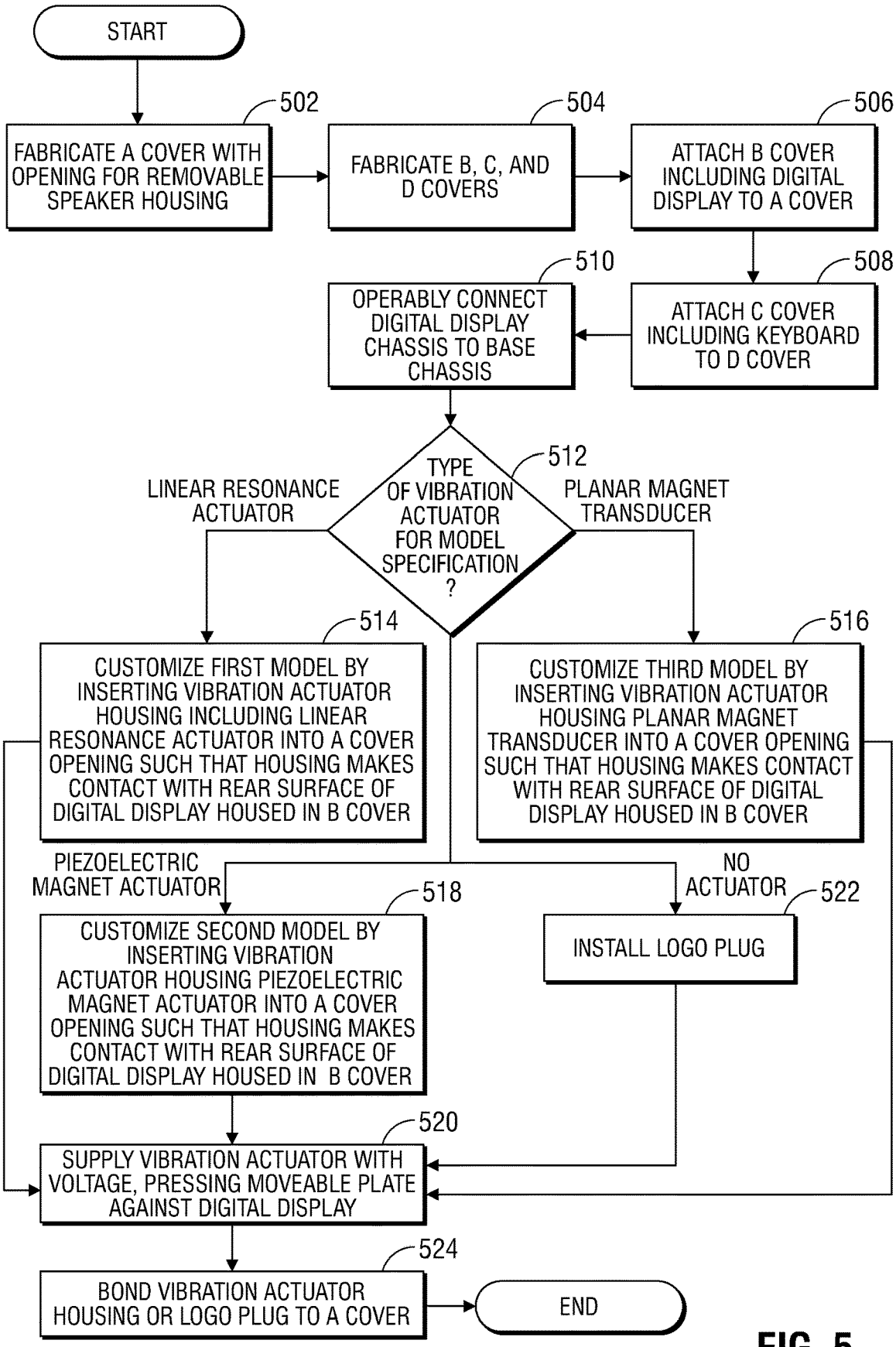
FIG. 5 is a flow diagram illustrating a method of fabricating a form-factor information handling system chassis according to an embodiment of the present disclosure.

FIG. 5 is a flow diagram illustrating a method of fabricating a vibration actuator housing disposed within an information handling system chassis according to an embodiment of the present disclosure. As described herein, embodiments of the present disclosure incorporate an acoustic vibrator within a chassis lid A-cover, actuating movement of a digital display to vibrate and generate audible sound or sub-audible vibration used in tactile response methods. Also, the A-cover and cap may project the audible sound or sub-audible vibration. Such a use of the digital display in such an embodiment may enhance vibrational tactile feedback, or negate the need for other, bulkier speakers used in previous mobile devices prior to the advent of narrow bezel technology, and thin base chassis, resulting in a slimmer, more desirable chassis form.

At block 502, in an embodiment, an A cover may be fabricated with an opening for insertion of a removable speaker housing. The A cover may be fabricated using any known material used in existing or future clamshell, tablet, or other mobile devices. For example, the A cover may comprise a plastic material, aluminum, stainless steel or other metal, carbon fiber, composite materials, or any combinations of the aforementioned. An opening may be made throughout the thickness of a portion of the A cover in an embodiment, for insertion of a removable speaker housing. Such an opening in some embodiments may have a stepped profile shape optimized for alignment and affixation of removable speaker module 420, through the use of for example, alignment keyways, pins, surface texturing, and other bonding and assembly optimizations commonly used in the art. The exterior surface of the A-cover in an embodiment may have a curvilinear shape, and the exterior surface of the removable speaker housing may be shaped or formed to lie flush with the curvilinear edges of the A-cover upon insertion. For example, in an embodiment described with reference to FIG. 4, a hole may be made throughout the vertical thickness of a portion of the A cover 410, for insertion of the removable speaker housing 420. Such an opening in an embodiment may be formed as the A cover 410 is also being fabricated (e.g., using a 3D printing process or other additive manufacturing process). In another embodiment, the opening allowing for insertion of the removable speaker housing 420 may be made in the A cover 410 by subtracting an opening through the A cover 410 after the A cover 410 has been fabricated through mechanical, chemical, photo-ablative, or other subtractive manufacturing methods known in the art.

The removable speaker housing 420 in such an embodiment may incorporate one or more of various types of vibration actuators 424 (e.g., linear resonant actuator, planar magnetic transducer, piezoelectric magnetic actuator, or some other known type of mechanical actuator). Some model specifications may call for no added A-cover speaker, in which case a non-functional plug may be inserted. Further, in other embodiments, the opening fabricated within the A cover 410 in such an embodiment may be shaped to accommodate insertion of multiple models or types of removable speaker housings 420 for various model specification options. For example, a speaker housing 424 including a linear resonant actuator may have dimensions allowing it to be inserted through the opening formed in the A cover 410 in an embodiment. In the same embodiment, another speaking housing (not shown) including a planar magnetic transducer may also have dimensions allowing it to be inserted through the opening disposed through the A cover 410. Thus, multiple different types of removable speaker housings, each incorporating different types or different combinations of multiple types of vibration actuators may be interchangeable with one another in their ability to be inserted within the opening fabricated throughout the thickness of a portion of the A cover 410 depending on the speaker options or combinations ordered for a model specification.

B, C, and D covers of a chassis for an information handling system may be fabricated at block 504 in an embodiment. For example, in an embodiment described with reference to FIG. 2, the B cover 214 may be fabricated to have dimensions allowing for the enclosure or partial housing of the digital display 212. The C cover 224 may be fabricated to enclose or partially house the keyboard 222, and the D cover 226 may be fabricated to protect components placed between the C cover 224 and the D cover 226 from environmental factors. Similar to the A cover, the B, C, and D covers in an embodiment may be fabricated using any known material used in existing or future clamshell, tablet, or other mobile devices (e.g., plastic material, aluminum, stainless steel or other metal, carbon fiber, composite materials, or any combinations of the aforementioned). In some embodiments, fabrication of the A cover may occur simultaneously or after fabrication of the B, C, and D covers.

At block 506, the B cover including the digital display may be attached to the A cover. For example, in an embodiment described with reference to FIG. 2, the B cover 214 surrounding or partially enclosing the digital display 212 may be operably attached to the A cover (not shown) so as to completely enclose the rear surface of the digital display 212 within the display chassis 210. The A cover may be attached to the B cover in an embodiment with mechanical fasteners (snaps or clips), screws, bonding materials (glues, epoxies, magnets), or any other known methods or combination of known methods for attaching multiple components of a display chassis.

The C cover may be attached to the D cover at block 508 in an embodiment. For example, in an embodiment described with reference to FIG. 2, the C cover 224 surrounding or partially enclosing the keyboard 222 may be operably attached to the D cover 226 so as to completely enclose the bottom surface of the keyboard 222 and other components within the base chassis 220. The C cover 224 may be attached to the D cover 226 in an embodiment with mechanical fasteners (snaps or clips), screws, bonding materials (glues, epoxies, magnets), or any other known methods or combination of known methods for attaching multiple components of a base chassis. In some embodiments, attachment of the A and B covers may occur simultaneously or after attachment of the C and D covers.

At block 510, the digital display chassis may be operably connected to the base chassis in an embodiment. For example, in an embodiment described with reference to FIG. 2, the digital display chassis 210 may be operably connected to the base chassis 220 via a hinge 230 that allows the display chassis 210 to rotate with respect to the base chassis 220. The hinge 230 in such an embodiment may be a permanent hinge, or may be a releasable hinge (e.g., incorporating magnetic elements) allowing for detachment of the digital display chassis 210 from the base chassis 220. In other embodiments, the display chassis 210 may operate as a tablet device, or other mobile device (e.g., smartphone) and may not be operably attached to a base chassis incorporating a keyboard. The hinge 230 may also include one or more power and data hardware to operatively connect components in the base chassis 330 to components in the display chassis 210.

A type of vibration actuator may be selected for insertion into the display chassis in an embodiment at block 512 if selected as part of a model specification. As described herein, the opening formed in the A cover for insertion of the vibration actuator in an embodiment may accommodate any of a plurality of interchangeable vibration actuator housings, each containing different types of actuators or a logo plug if no actuator speaker is chosen. Further, each different type or combination of types of actuators within an interchangeable vibration actuator housing in an embodiment may be capable of causing the flexible rear surface of the digital display to produce a different range of audible sound frequencies, or sub-audible vibration used as tactile feedback. Thus, the type or combination of types of vibration actuators selected for insertion within the opening in the A cover may depend in an embodiment upon the range of sound frequencies the user wishes to hear, a choice of tactile feedback methods, or upon the intended use of the information handling system within the chassis. The selection may also depend on the other speaker systems deployed elsewhere in the information handling system. For example, a smartphone or tablet user may rely more heavily on peripherally attached headphones or ear buds, rather than speakers incorporated within the smartphone chasses to listen to audio content. Thus, in an embodiment including a smartphone or tablet chassis, a vibration actuator capable of producing a more narrow range of frequencies, such as base frequencies, than other available vibration actuators may be chosen. In contrast, and as another example, an information handling system marketed as a gaming platform may incorporate a plurality of vibration actuators, in the A-cover or elsewhere, to increase the range of audible sound frequencies achievable, and thus increase the quality and depth of sound available. In still other embodiments, the type and number of vibration actuators chosen for insertion into the A cover opening may depend upon price. For example, models incorporating linear resonance actuators may cost less than models incorporating planar magnetic transducers, and models incorporating a single actuator may cost less than models incorporating multiple actuators.

If a linear resonance actuator is chosen, the method may proceed to block 514. If a planar magnet transducer is chosen, the method may proceed to block 516. If the piezoelectric magnetic actuator is chosen, the method may proceed to block 518. If no actuator is chosen, the method may proceed to block 522. In still other embodiments (not described in FIG. 5) a vibration actuator housing incorporating a combination of vibration actuators may be chosen. In such an embodiment, the method may further include inserting the vibration actuator housing a combination of vibration actuators into the opening in the A cover. The method may then proceed to block 520 or block 522 in such an embodiment.

At block 514, in an embodiment in which a linear resonance actuator is chosen as the vibration actuator, the A, B, C, and D covers may be incorporated into a first model of information handling system by inserting a vibration actuator housing including a linear resonance actuator into the opening formed in the A cover. For example, in an embodiment described with reference to FIG. 4, the vibration actuator 424 housed within the vibration actuator housing 420 may comprise a linear resonant actuator that receives commands in the form of alternating current to drive a suspended voice coil within the vibration actuator 424. The linear resonance actuator 424 within the vibration actuator housing 420 in such an embodiment may also be operatively connected to a speaker driver, the vibration actuation speaker system, or to a microcontroller (e.g., tactile feedback microcontroller) of the information handling system at this point. The position of the vibration actuator 424 with respect to the A cover 410 in such an embodiment may be fixed, such that vibration actuator 424 may cause vertical movement of the moveable plate 426 with respect to the A cover 410, which may also cause contact between the membranous or flexible rear surface of the digital display 430 and the moveable plate 426. Movement of the moveable plate 426 in such an embodiment may thus affect movement of the rear surface of the digital display 430 to cause an audible sound or vibrational tactile feedback. Because the various types of vibration actuator housings 420 are interchangeable with one another, the method may then proceed to block 520, regardless of the type of vibration actuator (or combination of types of vibration actuators) chosen at block 512.

In an embodiment in which a planar magnet transducer is chosen as the vibration actuator, the A, B, C, and D covers may be incorporated into a second model of information handling system at block 516 by inserting a vibration actuator housing including a planar magnet transducer into the opening formed in the A cover. For example, in another embodiment described with reference to FIG. 4, the vibration actuator 424 may comprise a planar magnetic transducer, including one or more permanent magnets and electrically conductive wires placed in contact with the rear surface of the digital display 430. The planar magnet transducer 424 within the vibration actuator housing 420 in such an embodiment may also be operatively connected to a speaker driver, the vibration actuation speaker system, or to a microcontroller (e.g., tactile feedback microcontroller) of the information handling system at this point. Interaction between a voltage applied to the electrically conductive wires and the permanent magnets in such an embodiment may cause the membranous rear surface of the digital display 430 to move or vibrate, causing audible sound or vibrational tactile feedback. The method may than proceed to block 520.

At block 518, in an embodiment in which a piezoelectric magnet actuator is chosen as the vibration actuator, the A, B, C, and D covers may be incorporated into a third model of information handling system by inserting a vibration actuator housing including a piezoelectric magnetic actuator into the opening formed in the A cover. For example, in yet another embodiment described with reference to FIG. 4, the vibration actuator 424 may comprise a piezoelectric magnetic actuator that deforms a piezoelectric material within the vibration actuator 424 in response to application of an electrical voltage to the material. The piezoelectric magnet actuator 424 within the vibration actuator housing 420 in such an embodiment may also be operatively connected to a speaker driver, the vibration actuation speaker system, or to a microcontroller (e.g., tactile feedback microcontroller) of the information handling system at this point. Movement of the piezoelectric material within the vibration actuator 424, placed in close contact with the rear surface of the digital display 430 in such an embodiment may also move the flexible rear surface of the digital display 430, to emit audible sound or vibrational tactile feedback. The method may than proceed to block 520.

The vibration actuator may be supplied with a voltage at block 420 in an embodiment, to assist in pressing moveable plate against digital display during assembly. For example, such a voltage may be applied in an embodiment described with reference to FIG. 4 to the vibration actuator 424 to press movable plate 426 against digital display 430 in order to increase the contact surface area between the two surfaces, which may result in a stronger or more uniform fixation of the moveable plate 426 to the digital display 430. The voltage applied to actuator 424 may be generated internally from within components of information handling system 100, or externally from assembly equipment employed in the fabrication or integration process.

At block 522, the vibration actuator housing in an embodiment may be bonded to the A cover. For example, in an embodiment described with reference to FIG. 4, the removable speaker housing 410 may be bonded, glued, or otherwise fixed in place with respect to the A cover 410 in an embodiment. The method may then end. In such a way, a plurality of different information handling system models may be fabricated, with each model incorporating a different type or combination of types of vibration actuator speakers. Further, each of these different types or combinations of types of vibration actuator speakers may be housed within interchangeable vibration actuator housings in various embodiments. Each of the types of combinations of types of vibration actuators incorporated in the various models fabricated in such a way may operate by vibrating at least a portion of the flexible or membranous digital display, thus negating a need for additional, bulky components. In such a way, embodiments of the present disclosure successfully remove speakers from the B cover surrounding the digital display (e.g., as fabricated using narrow bezel technology), while also maintaining the slim, lightweight form factor demanded in the marketplace.

In an embodiment in which no actuator has been chosen at block 512, a plug bearing a logo may be inserted within the opening in the A cover at block 522. The plug may not include a vibration actuator. The logo plug may then be bonded to the A cover at block 520. The method may then end. In such a way, the method of FIG. 5 may be used to fabricate an A-cover that may be joined with a plurality of vibration actuators, or an inert plug, to offer customers a variety of models having varying speaker specifications using the same base A-cover.

The blocks of the flow diagrams of FIG. 5 or steps and aspects of the operation of the embodiments herein and discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A vibration actuation speaker system of an information handling system comprising:

an information handling system A-cover housing a digital display, operably connected, via a hinge, to an information handling system chassis base;

the A-cover having an opening into a space between the A-cover and a rear surface of the digital display to accommodate insertion of one of a plurality of interchangeable vibration actuator housings selected from a plurality of different types of vibration actuators or combination of vibration actuators;

a first of the plurality of interchangeable vibration actuator housings enclosing a first vibration actuator inserted into the opening of the A-cover;

a first surface of one of a plurality of vibration actuator housings lying substantially coplanar with an A-cover rear surface;

a second surface of the one of the plurality of vibration actuator housings situated adjacent the rear surface of the digital display;

a microprocessor transmitting machine executable code instructions of the vibration actuation speaker system to the first vibration actuator; and the first vibration actuator transducing the code instructions to cause a first corresponding movement of at least a portion of the digital display to produce a vibration.

2. The information handling system of claim 1, wherein the first vibration actuator is a linear acoustic actuator including a voice coil.

3. The information handling system of claim 1, wherein the first vibration actuator is a planar magnet transducer.

4. The information handling system of claim 1, wherein the first vibration actuator is a piezoelectric magnet actuator.

5. The information handling system of claim 1, wherein the produced vibration provides a tactile feedback in response to a received user input.

6. The information handling system of claim 1, wherein the produced vibration generates audible sound.

7. The information handling system of claim 6, wherein the first vibration actuator causes production of audible sound within a first range of frequencies, further comprising:

the information handling system base chassis housing an additional speaker capable of producing sound in a second range of frequencies, outside the first range of frequencies.

8. A method of fabricating a form factor information handling system chassis comprising:

operably connecting an information handling system A-cover housing a digital display to an information handling system chassis base, via a hinge;

forming an opening of the A-cover into a space between the A-cover and a rear surface of the digital display to accommodate insertion of one of a plurality of interchangeable vibration actuator housings selected from a plurality of different types of vibration actuators or combination of vibration actuators;

inserting a first of the plurality of interchangeable vibration actuator housings enclosing a first vibration actuator into the opening of the A-cover, such that a first surface of one of a plurality of vibration actuator housings lies substantially coplanar with an A-cover rear surface, and a second surface of the one of the plurality of vibration actuator housings is situated adjacent the rear surface of the digital display;

supplying a voltage to the first vibration actuator via a microcontroller, to increase contact surface area between the first vibration actuator and the rear surface of the digital display;

transmitting machine executable code instructions of a vibration actuation speaker system, via a microprocessor, to the first vibration actuator; and transducing the code instructions, via the first vibration actuator, to cause a first corresponding movement of at least a portion of the digital display to produce audible sound.

9. The method of claim 8, wherein the first vibration actuator is a linear acoustic actuator including a voice coil.

10. The method of claim 8, wherein the first vibration actuator is a planar magnet transducer.

11. The method of claim 8, wherein the first vibration actuator is a piezoelectric magnet actuator.

12. The method of claim 8 further comprising:

causing production of audible sound within a first range of frequencies via the first vibration actuator; and producing sound in a second range of frequencies, outside the first range of frequencies, via an additional speaker housed within the information handling system base chassis.

13. The method of claim 8, wherein the first vibration actuator housing is removable with respect to the information handling system chassis.

14. The method of claim 8 further comprising:

causing production of audible sound within a first range of frequencies via the first vibration actuator; and wherein the first vibration actuator housing is interchangeable with a second vibration actuator housing enclosing a second vibration actuator capable of causing a second corresponding movement of at least a portion of the digital display to produce audible sound in a second range of frequencies, outside the first range of frequencies.

15. A vibration actuation speaker system of an information handling system comprising:

an information handling system A-cover housing a digital display, operably connected, via a hinge, to an information handling system chassis base;

the A-cover having an opening into a space between the A-cover and a rear surface of the digital display to accommodate insertion of one of a plurality of interchangeable vibration actuator housings selected from a plurality of different types of vibration actuators or combination of vibration actuators;

a first of the plurality of interchangeable vibration actuator housings enclosing a first vibration actuator inserted into the opening of the A-cover;

a first surface of one of a plurality of vibration actuator housings lying substantially coplanar with an A-cover rear surface;

a second surface of the one of the plurality of vibration actuator housings situated adjacent the rear surface of the digital display;

a microprocessor transmitting machine executable code instructions of the vibration actuation speaker system to the first vibration actuator;

the first vibration actuator transducing the code instructions to cause a first corresponding movement of at least a portion of the digital display to produce audible sound in a first range of frequencies; and the information handling system base chassis housing an additional speaker capable of producing sound in a second range of frequencies, outside the first range of frequencies.

16. The information handling system of claim 15, wherein the first vibration actuator is a linear acoustic actuator including a voice coil.

17. The information handling system of claim 15, wherein the first vibration actuator is a planar magnet transducer.

18. The information handling system of claim 15, wherein the first vibration actuator is a piezoelectric magnet actuator.

19. The information handling system of claim 15, wherein the first vibration actuator housing is removable with respect to the information handling system chassis.

20. The information handling system of claim 15, wherein the first vibration actuator causes production of the audible sound within the first range of frequencies, and the first vibration actuator housing is interchangeable with a second vibration actuator housing enclosing a second vibration actuator capable of causing a second corresponding movement of at least a portion of the digital display to produce an audible sound in a third range of frequencies, outside the first range of frequencies.

* * * * *